US007853192B2

(12) United States Patent
Nagao et al.

(10) Patent No.: US 7,853,192 B2
(45) Date of Patent: Dec. 14, 2010

(54) PAPER DISCHARGE STRUCTURE AND IMAGE FORMING APPARATUS USING THE SAME

(75) Inventors: Hiroyuki Nagao, Nara (JP); Takashi Kikutani, Nara (JP); Kazuhisa Yoneda, Nara (JP); Yasushi Nakamura, Yamatokoriyama (JP); Toshikazu Kitaura, Kashihara (JP); Hidenobu Mandai, Nara (JP)

(73) Assignee: Sharp Kabushiki Kaisha, Osaka (JP)

( * ) Notice: Subject to any disclaimer, the term of this patent is extended or adjusted under 35 U.S.C. 154(b) by 728 days.

(21) Appl. No.: 11/785,207

(22) Filed: Apr. 16, 2007

(65) Prior Publication Data

US 2007/0286657 A1 Dec. 13, 2007

(30) Foreign Application Priority Data

May 10, 2006 (JP) ..... 2006-131438

(51) Int. Cl.
*B65H 29/22* (2006.01)
*B65H 31/02* (2006.01)

(52) U.S. Cl. ..... 399/405

(58) Field of Classification Search ..... 399/405; 271/207; *B65H 29/22, 31/02, 31/04, 31/06, B65H 31/08, 31/10*

See application file for complete search history.

(56) References Cited

U.S. PATENT DOCUMENTS 3,815,899 A 6/1974 Hatzmann
4,664,368 A 5/1987 Bouwens et al.
5,913,095 A * 6/1999 Takashima et al. ..... 399/125
6,112,047 A * 8/2000 Kato et al. ..... 399/381
6,788,905 B2 * 9/2004 Tsutada ..... 399/45
2005/0220520 A1 * 10/2005 Kawamoto ..... 399/405

FOREIGN PATENT DOCUMENTS

JP 50-112048 3/1974
JP 61-203064 9/1986
JP 11-100161 4/1999
JP 2001002308 A * 1/2001
JP 2002080160 A * 3/2002
JP 2006117379 A * 5/2006

* cited by examiner

*Primary Examiner*—Judy Nguyen
*Assistant Examiner*—Jennifer Simmons
(74) *Attorney, Agent, or Firm*—Birch, Stewart, Kolasch & Birch, LLP

(57) ABSTRACT

A paper discharge structure includes: a paper discharge roller for discharging paper with an image from a discharge port; a paper output tray located below the paper discharge roller for holding sheets of paper P discharged by the paper discharge roller; and a side-wall surface formed extending from the vicinity of the paper discharge roller to the vicinity of the paper output tray, is constructed such that the side-wall surface is formed with an inclined portion that extends from the lower part of the paper discharge roller to the vicinity of the paper output tray and is inclined with respect to the vertical direction.

10 Claims, 7 Drawing Sheets

PAPER DISCHARGE STRUCTURE AND IMAGE FORMING APPARATUS USING THE SAME

This Nonprovisional application claims priority under 35 U.S.C. §119(a) on Patent Application No. 2006-131438 filed in Japan on 10 May 2006, the entire contents of which are hereby incorporated by reference.

BACKGROUND OF THE INVENTION (1) Field of the Invention

The present invention relates to a paper discharge structure and an image forming apparatus, in particular relating to a paper discharge structure whereby a recording medium with an image formed thereon by an electrophotographic process is discharged onto a paper output tray by means of paper discharge rollers, as well as relating to an image forming apparatus using the structure.

(2) Description of the Prior Art

Conventionally, in the paper discharge structure used in an image forming apparatus such as a copier, scanner device, facsimile machine, etc., the output sheets are usually discharged onto a paper output tray. The stacking performance of the sheets discharged on this paper output tray is one of the important factors for the user to achieve their task efficiently.

Specifically, the point is whether the user is able to obtain discharged sheets in an organized manner as they are just taken out from the output tray or the user needs to tidy up the stack of discharged sheets once again after they are taken out. That is, there is a demand for a paper discharge structure that provides user-friendly stacking performance of discharged sheets.

On the other hand, in recent years image forming apparatuses have been enhanced in speed, and also so-called multi-functional machines having multiple functions have been developed and put into practical use. These high-speed machines as well as multi-functional machines are also demanded to be compact without bulkiness. As a result the space given for the paper discharge structure has become designed to be small.

To achieve this it is necessary to reduce the volume of the paper discharge structure. However, this entails degradation of the stacking performance of discharged paper on the paper output tray.

To deal with this, as a conventional technology there has been a proposal of a sheet handling apparatus for discharging sheets onto a paper output tray with its stacking performance improved by increasing or decreasing the discharging speed of sheets without drastically changing the apparatus configuration (see Japanese Patent Application Laid-open 2000-118824).

However, since this scheme needs to increase and decrease the speed of sheet output, there is a fear that it is impossible to achieve a desired number of outputs for supporting recent high-speed configurations.

Further, when a large amount of sheets are output, the discharged sheets of paper fall at different positions, so that the stacked conditions of individual sheets are diversified, causing the rear ends of sheets to be stacked uneven. As a result, in some cases there is a risk that a designated amount of sheets cannot be accommodated because the output sheets lean against the wall of the paper discharge portion. To avoid this, it is necessary to discharge paper at a suitable position by controlling the speed of discharging the paper, and this in turn causes the problem in that the speed control of paper discharge is complicated and stable output speed cannot be obtained.

SUMMARY OF THE INVENTION

In view of the above conventional problems, it is therefore an object of the present invention to provide a paper discharge structure which has a simple configuration, can discharge paper correctly onto a paper output tray and is improvised in stacking performance of discharged sheets of paper, as well as to provide an image forming apparatus using this paper discharge structure.

The paper discharge structure according to the present invention and the image forming apparatus using this for solving the above problems are configured as follows.

A paper discharge structure in accordance with the first aspect of the present invention, includes: a paper discharge roller for discharging a recording medium with an image formed thereon from a discharge port; a paper output tray located below the paper discharge roller for holding recording mediums discharged by the paper discharge roller; and a side-wall surface formed extending from the vicinity of the paper discharge roller to the vicinity of the paper output tray, and is characterized in that the side-wall surface is formed with an inclined portion that extends from the lower part of the paper discharge roller to the vicinity of the paper output tray and is inclined with respect to the vertical direction.

A paper discharge structure in accordance with the second aspect of the invention has the configuration described in the above first aspect, and is further characterized in that the inclined portion is formed so that its angle of inclination with respect to the vertical direction is made greater at the paper output tray side than at the paper discharge roller side.

A paper discharge structure in accordance with the third aspect of the invention has the configuration described in the above second aspect, and is further characterized in that the inclined portion is formed so that its angle of inclination is made greater stepwise as it becomes more distant from the paper discharge roller.

A paper discharge structure in accordance with the fourth aspect of the invention has the configuration described in any one of the above first to third aspects, and is further characterized in that the angle of inclination of the inclined portion is determined based on the distance from the paper discharge roller to the paper output tray, the length of the longest recording medium of the recording mediums that can be handled and discharged from the paper discharge roller and the position, on the paper discharge tray, which the front end of the longest recording medium reaches when the rear end of the recording medium is released from the paper discharge roller.

A paper discharge structure in accordance with the fifth aspect of the invention has the configuration described in the above fourth aspect, and is further characterized in that the position, on the paper discharge tray, which the front end of the longest recording medium reaches when the rear end of the recording medium is released from the paper discharge roller is determined based on the angle of inclination of the recording medium stacking portion of the paper output tray.

An image forming apparatus in accordance with the sixth aspect of the invention includes: a recording medium conveying portion for conveying recording mediums; an image forming portion for forming an image on a recording medium being conveyed, in accordance with input image information; and a paper discharge structure comprising: a paper discharge roller for discharging a recording medium with an image formed thereon from a discharge port; a paper output tray located below the paper discharge roller for holding recording mediums discharged by the paper discharge roller; and a side-wall surface formed extending from the vicinity of the paper discharge roller to the vicinity of the paper output tray, and is characterized in that the paper discharge structure has one of the above first to fifth aspects.

According to the first aspect of the invention, in the paper discharge structure including: a paper discharge roller for discharging a recording medium with an image formed thereon from a discharge port; a paper output tray located below the paper discharge roller for holding recording mediums discharged by the paper discharge roller; and a side-wall surface formed extending from the vicinity of the paper discharge roller to the vicinity of the paper output tray, the side-wall surface is formed with an inclined portion that extends from the lower part of the paper discharge roller to the vicinity of the paper output tray and is inclined with respect to the vertical direction. This configuration is simple and still makes it possible to correctly discharge the recording mediums onto the paper output tray without causing the rear ends of the recording mediums to stagnate and lean against the side-wall surface. Accordingly, it is possible to markedly improve the stacking performance of discharged paper, and hence achieve an improved workability when the user takes out and collects the output recording mediums.

In accordance with the inventions according to the second to fifth aspects of the present invention, the following effects can be obtained in addition to the above common effect which can be obtained from the first aspect of the invention.

That is, in accordance with the second aspect of the present invention, in addition to the effect achieved by the first aspect of the invention, the inclined portion is formed so that its angle of inclination with respect to the vertical direction is made greater at the paper output tray side than at the paper discharge roller side. Accordingly, it is possible to avoid interference of the rear end of the recording medium with the side-wall portion due to variation of the position of the rear end of the recording medium depending on the falling position of the recording medium, hence this configuration makes it possible to correctly discharge the recording mediums onto the paper output tray without causing the rear ends to lean against the side-wall portion.

In accordance with the third aspect of the present invention, in addition to the effect achieved by the second aspect of the invention, the inclined portion is formed so that its angle of inclination is made greater stepwise as it becomes more distant from the paper discharge roller. Accordingly, even when the position or angle of the falling recoding medium varies depending on the stacked amount of discharged recording mediums, it is possible to avoid interference of the rear end of the recording medium with the side-wall portion, hence this configuration makes it possible to correctly discharge the recording mediums onto the paper output tray without causing the rear ends to lean against the side-wall portion.

In accordance with the fourth aspect of the present invention, in addition to the effect achieved by any one of the first to third aspects of the invention, the angle of inclination of the inclined portion is determined based on the distance from the paper discharge roller to the paper output tray, the length of the longest recording medium of the recording mediums that can be handled and discharged from the paper discharge roller and the position, on the paper discharge tray, which the front end of the longest recording medium reaches when the rear end of the recording medium is released from the paper discharge roller. This makes it possible to set the angle of inclination of the inclined portion in a simple manner. As a result, even if a large amount of discharged recording mediums are stacked, it is possible to correctly place the recording medium without its rear end leaning against the side-wall surface when the rear end of the recording medium reaches the top surface of the stack of recording mediums (onto the paper output tray).

In accordance with the fifth aspect of the present invention, in addition to the effect achieved by to the fourth aspect of the invention, the position, on the paper discharge tray, which the front end of the longest recording medium reaches when the rear end of the recording medium is released from the paper discharge roller is determined based on the angle of inclination of the recording medium stacking portion of the paper output tray. This configuration makes it possible to set the angle of inclination of the inclined portion in a simple manner. As a result, even if a large amount of discharged recording mediums are discharged onto the inclined paper output tray, it is possible to correctly place the recording medium without its rear end leaning against the side-wall surface when the rear end of the recording medium reaches the top surface of the stack of recording mediums (onto the paper output tray).

In accordance with the sixth aspect of the present invention, in an image forming apparatus in accordance with the sixth aspect of the invention includes: a recording medium conveying portion for conveying recording mediums; an image forming portion for forming an image on a recording medium being conveyed, in accordance with input image information; and a paper discharge structure comprising: a paper discharge roller for discharging a recording medium with an image formed thereon from a discharge port; a paper output tray located below the paper discharge roller for holding recording mediums discharged by the paper discharge roller; and a side-wall surface formed extending from the vicinity of the paper discharge roller to the vicinity of the paper output tray, the paper discharge structure adopts one of the above first to fifth configuration. Accordingly, this makes it possible with a simple configuration to correctly discharge the recording mediums onto the paper output tray without causing the rear ends of the recording mediums to stagnate and lean against the side-wall surface. Accordingly, it is possible to markedly improve the stacking performance of discharged paper, and hence achieve an improved workability when the user takes out and collects the output recording mediums.

DESCRIPTION OF THE PREFERRED EMBODIMENTS

The embodiment of the present invention will hereinafter be described in detail with reference to the drawings.

Figure 1:
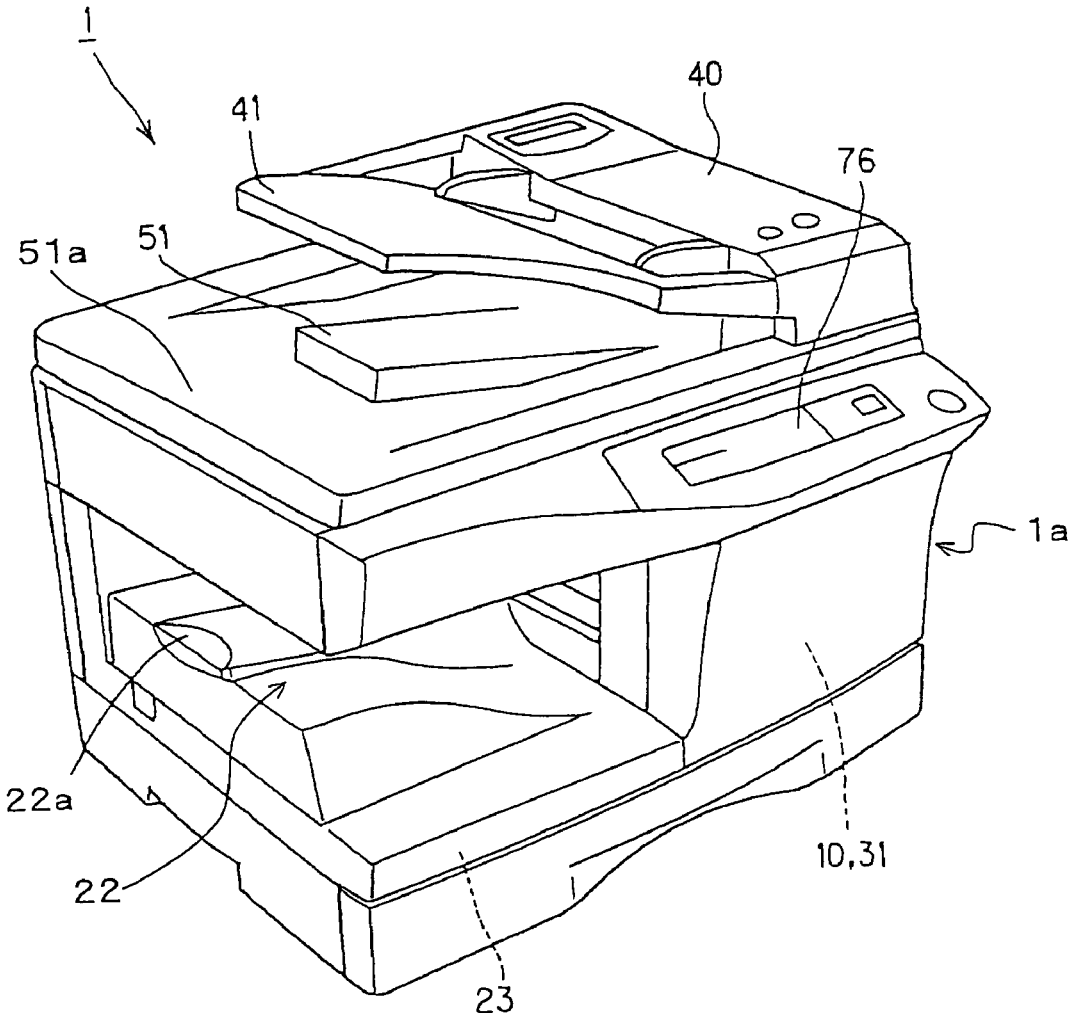
FIG. 1 is a perspective view showing an overall configuration of an image forming apparatus according to the embodiment of the present invention.
Figure 2:
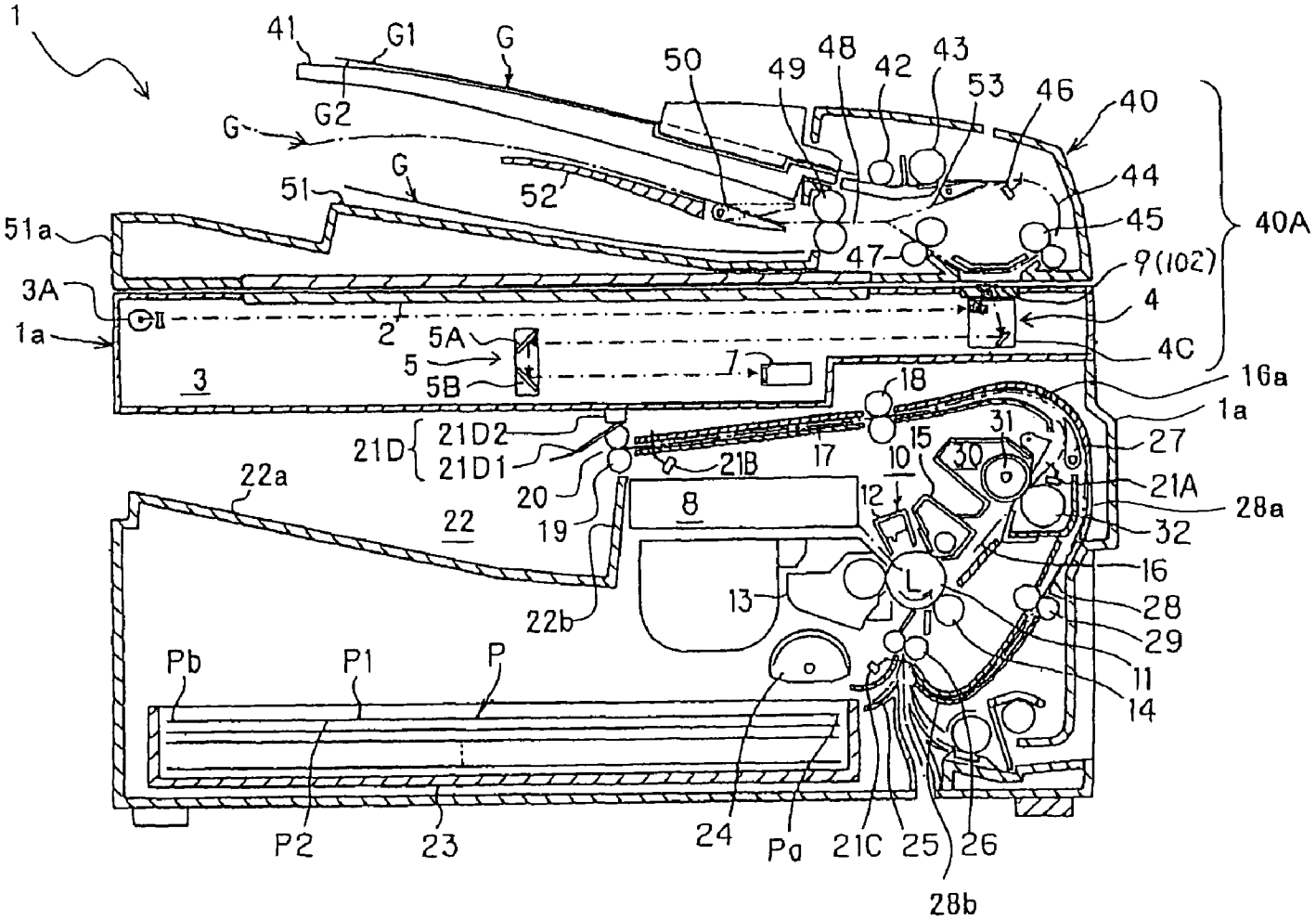
FIG. 2 is a sectional side view showing an internal configuration of the image forming apparatus.

FIGS. 1 and 2 show one example of the embodiment of the present invention. FIG. 1 is a perspective view showing the overall configuration of an image forming apparatus according to one embodiment of the present invention in which a paper discharge structure according to the present invention is adopted, and FIG. 2 is a sectional side view showing the internal configuration of the image forming apparatus.

To begin with, the overall configuration of an image forming apparatus 1 according to the present embodiment will be described.

Image forming apparatus 1 according to the present embodiment includes an image reader 40A for reading image information from an original G, and outputs the image information of original G, captured by the image reader 40A, by electrophotographically forming a monochrome image on recording paper of a predetermined sheet-like material (to be referred to hereinbelow as the paper) as a recording medium.

As shown in FIGS. 1 and 2, image forming apparatus 1 is provided with an original placement table (e.g., platen glass) 2 of transparent glass on which original G is placed, on the top of an apparatus body 1*a*. There is an automatic document processor 40 on the top of this original placement table 2 while a scanner portion (image reading portion) 3 as an image reader for reading image information from original G is arranged under this original placement table 2.

The original placement table 2, scanner portion 3 and automatic document processor 40 and others constitute the image reader 40A.

Arranged under scanner portion 3 are an image forming portion 10, a fixing unit 30 and a paper discharge portion (paper discharge structure) 22. Provided further below is a paper feed cassette 23 which stores recording paper as recording media.

Scanner portion 3 is essentially composed of first and second scanner units 4 and 5 which are arranged under original placement table 2 and move reciprocatively in parallel therewith, an original image reading unit including a CCD (photoelectric transducer) 7 and an exposure lamp (light source) 3A.

Exposure lamp 3A has a light source and an optical lens element, and is fixed on one end side inside the body of scanner portion 3, at a position opposing the side end of first scanner unit 4 with respect to the main scan direction and in an area where it will not interfere with the movement of first scanner unit 4 and second scanner unit 5, and illuminates first scanner unit 4 along the sub-scan direction of scanner portion 3.

In the drawing, the optical path of the emitted light from exposure lamp 3A is shown with a dashed line.

Figure 3:
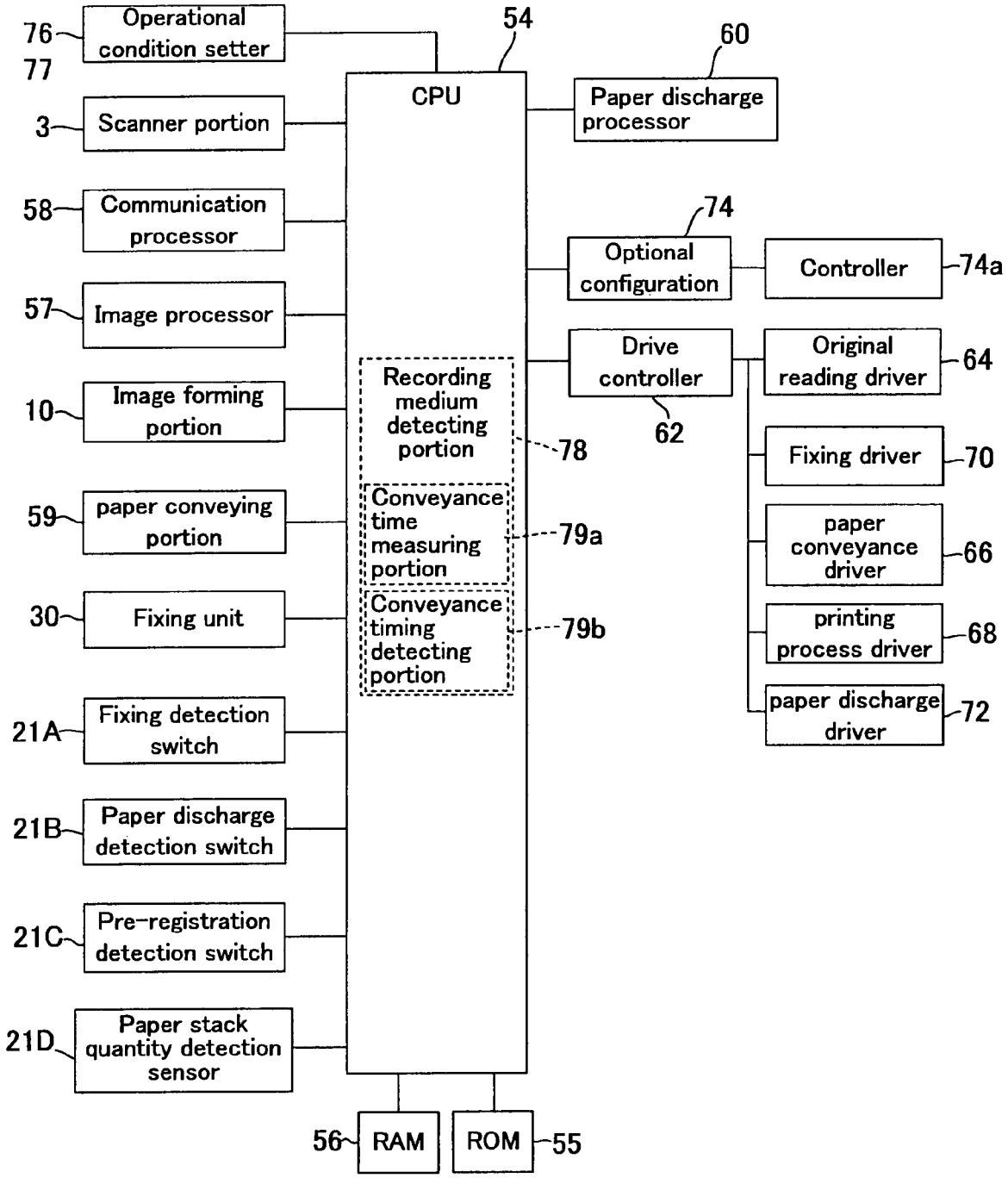
FIG. 3 is a block diagram showing a configuration of an electric controller of the image forming apparatus.

CCD (charge coupled device) 7 reads the light image of an original image and photoelectrically converts it into electric signals to thereby create original image information (original image data) and outputs the original image information to an aftermentioned image processor 57 (see FIG. 3).

Image processor 57 performs image processing on the original image information output from CCD 7 to produce printing image information (printing image data) with a resolution, density, etc. suited for printing. The print image information obtained as a result of the image processing is transferred to an image data input portion of a laser scanning unit (LSU) 8.

Laser scanning unit 8 emits laser beams in accordance with the printing image information output from image processor 57 to illuminate the surface of a photoreceptor drum 11 as a constituent of image forming portion (image forming process) 10. Thereby, an electrostatic latent image of the printing image information is written on photoreceptor drum 11.

As shown in FIG. 2, image forming portion 10 is essentially comprised of photoreceptor drum 11 driven to rotate in the direction of the arrow, a main charger 12 for electrifying the photoreceptor drum 11 surface at a predetermined potential, laser scanning unit 8 for illuminating the photoreceptor drum 11 surface with laser beams for forming an electrostatic latent image, a developing unit 13 for visualizing the electrostatic latent image formed by irradiation of the laser beams from the laser scanning unit 8, with toner, a transfer roller 14 for transferring the toner image of the original image visualized by the developing unit 13 to the paper (corresponding to "recording medium": also called "print paper") P that is fed from an aftermentioned paper feed cassette 23 through a paper feed path 25, and a cleaning unit 15 for cleaning the leftover toner remaining on the photoreceptor drum 11 after transfer by the transfer roller 14, all these elements being arranged in the order mentioned along the photoreceptor drum 11 in its rotational direction.

Main charger 12 of image forming portion 10 also has the function of an unillustrated charge erasing device for erasing electricity on the photoreceptor drum 11 surface after cleaning by cleaning unit 15.

Fixing unit 30 has a heat roller 31 and a pressing roller 32 as shown in FIG. 2, and fuses the toner image transferred on paper P and fixes the toner image to paper P as the paper P is passed through and between heat roller 31 and pressing roller 32 by rotating heat roller 31 while the paper P being nipped between the heat roller 31 and pressing roller 32.

The paper P with a toner image transferred thereon as it being nipped between photoreceptor drum 11 and transfer roller 14 is separated from photoreceptor drum 11 and conveyed along a main conveying path 16 that joins the photoreceptor drum 11 and fixing unit 30 into and between heat roller 31 and pressing roller 32 of the fixing unit 30. Heat roller 31 and pressing roller 32 abut each other with a predetermined pressing force, forming a nip portion at that contact.

In fixing unit 30, the paper P held between heat roller 31 and pressing roller 32, i.e., at the nip portion, is heated by heat roller 31 and pressed by pressing roller 32, so that the unfixed toner image that has been transferred from the photoreceptor drum 11 is fixed to the paper P.

The paper P after the fixing by fixing unit 30 is conveyed to paper discharge path 17 and further conveyed by a paper discharge drive roller 18 toward a paper discharge roller 19 on the paper discharge port 20 side.

The passage status of paper P being conveyed into paper discharge path 17 is detected by a fixing detection switch 21A arranged downstream of fixing unit 30 when the paper P passes by the nip between heat roller 31 and pressing roller 32.

For a case of usual one-sided printing, the paper is directly conveyed by the rotational drives of paper discharge drive roller 18 and paper discharge roller 19 and discharged through paper discharge port 20 onto a paper output tray 22*a* which is formed in a space under scanner portion 3. The passage status of paper P through paper discharge roller 19 is adapted to be detected by a paper discharge detecting switch 21B arranged upstream of paper discharge roller 19.

Paper P is discharged to the side of the image forming portion 10 and the discharged paper P is output over cassette 23 and under scanner portion 3.

Arranged at the inner bottom of main apparatus body 1*a* is an exchangeable paper feed cassette 23, in which a stack of recording paper P of a predetermined paper size is accommodated. A crescent-shaped sheet pickup roller 24 is arranged over the paper delivering side of this paper feed cassette 23.

This paper pickup roller 24 picks up the paper, sheet by sheet, from the topmost of a stack of paper P in paper feed cassette 23 and conveys the paper downstream (for convenience, the delivery side of recording paper P (the cassette side) is referred to as upstream and the direction of conveyance is referred to as downstream) to a registration roller (also called "idle roller") 26 in paper feed path 25.

A reference numeral Pa in the drawing designates the front end of paper P and Pb designates the rear end of paper P.

Arranged on the upstream side of registration roller 26 is a pre-registration detection switch 21C. This pre-registration detection switch 21C detects paper P that is fed and conveyed from paper feed cassette 23. This signal is used to adjust the paper feed timing of the paper to be fed to the aforementioned image forming portion 10.

In the case where duplex printing is performed, after printing by image forming portion 10 has been performed on one side of paper P, the paper P is sent into paper discharge path 17 after passage through fixing unit 30, then once conveyed to the paper discharge roller 19 side. In this condition, a paper path switching gate 27 that is disposed near fixing unit 30 is changed over, then paper discharge roller 19 is driven in reverse so that the paper P is switched back and guided into a sub conveyance path 28 for reversing the paper. Then, the thus guided paper P is rotationally driven by a sub-drive roller (inversion roller) 29 provided on this sub conveyance path 28 and conveyed to the upstream side of registration roller 26 once again, so that printing on the other side of paper P is performed.

On original placement table 2 of main apparatus body 1*a* an automatic document processor 40 of a document feed type reversing automatic document feeder (R-SPF) integrated with an original presser (original pressing cover) 51*a* is mounted in an openable manner, so that it constitutes image reader 40A in combination with scanner portion 3.

Image reader 40A is constructed so as to be able to perform an original reading operation for an individual document in the same control manner as in the conventional apparatus, and provision of automatic document processor 40 makes it possible to perform double-sided reading of original G and also perform automatic sequential reading of a multiple number of originals G.

As shown in FIG. 2, automatic document processor 40 has a document tray 41 on which originals G are set. When a multiple number of originals G are continuously read, the originals G set on this document tray 41 are picked up, sheet by sheet, by a document pickup roller 42 so that original G is guided by a document drive roller 43 into a document conveyance path 44 and conveyed to the upstream side of a registration roller (PS roller) 45.

Provided on the upstream side of this PS roller 45 is a document input sensor 46 for enabling detection of the document size of original G. This document input sensor 46 detects the leading and trailing edges of original G, so that based on the detected signals, the original G can be controlled and conveyed to an original reading station 9 of a glass slit located adjacent to one side of original placement table 2, taking into account the timing of delivery.

In this case, first scanner unit 4 of scanner portion 3 has been controlled and moved so that it is positioned under document reading station 9 for standby.

As to the scan of original G that is conveyed over this document reading station 9, one side of the original, namely, the first image-scan side G1 is scanned at document reading station 9 by first scanner unit 4 of scanner portion 3 while the original is being moved. Provided at this document reading station 9 is a contact glass 102 which keeps the distance between the document and scanner portion 3 uniform.

Other operations such as image reading by CCD 7, image processing of image information, image forming including printing etc., are performed in the same manner as above.

The original G that has been scanned over contact glass 102 is then conveyed by a conveyance roller 47 through a document discharge path 48 toward the document discharge roller 49 side.

When document reading is performed for one side only, the document is discharged onto a document output tray 51 by the switching control of a document switching gate 50.

When document reading is performed for both sides, by the switching control of document switching gate 50 original G is once discharged onto a middle tray 52 disposed between document tray 41 and document output tray 51, then is switched back into a document reversing path 53 by driving document discharge roller 49 in reverse. Then the original G is once again fed into document conveyance path 44 so that the original image on the underside of original G, namely the side G2 facing the image reader is scanned while the original image on the underside of original G is printed out on the first printing side P1 of paper P in the same manner as in the above-described one-side printing operation.

When this printing operation for the first printing side P1 of paper P has been finished, paper P is reversed by the above-described sheet reversing device, then fed again into image forming portion 10 so that the original image on the front side of original G that has been previously stored in the memory is printed on the second printing side P2.

As shown in FIG. 1, control switches 76 for allowing the user to set up the image forming conditions such as the sheet type of paper P (sheet thickness etc., in addition to sheet size), print number, magnification, density etc., are arranged on the front portion on the upper side of main apparatus body 1*a* of image forming apparatus 1.

Paper discharge portion 22 is mainly comprised of paper discharge path 17, paper discharge drive roller 18, paper discharge roller 19, paper discharge port 20 and paper output tray 22*a*.

Arranged on the outer side of paper discharge port 20 (on the paper output tray 22*a* side) is a paper stack quantity detecting sensor 21D, also called a full stack detecting sensor, as shown in FIG. 2.

Paper stack quantity detecting sensor 21D is mainly composed of a detecting piece 21D1 which operates when the paper discharged and stacked abuts the detecting piece, and a sensor body 21D2 which outputs a signal in accordance with the operation of detecting piece 21D1.

Detecting piece 21D1 has a rod-shaped configuration with its one end engaged with the sensor body 21D2 side so that the other end side can pivot on the first end, and the piece is arranged obliquely downward and outward from the apparatus side (paper discharge port 20 side).

With this structure, paper stack quantity detecting sensor 21D is adapted to output a detection signal from sensor body 21D2 as the second end of detecting piece 21D1 is pushed upward when the discharged amount of stacked paper has reached a predetermined amount (height).

Next, a specific paper conveyance path configuration for the image forming apparatus of the present embodiment will be described.

As shown in FIG. 2, the paper conveyance path in image forming apparatus 1 is mainly comprised of paper feed path 25 for feeding the paper upwards from paper feed cassette 23 arranged at the bottom of the machine to image forming portion 10, main conveyance path 16 for conveying the paper from image forming portion 10 to paper discharge drive roller 18 by way of fixing unit 30; paper discharge path 17 for conveying the paper from paper discharge drive roller 18 to paper discharge roller 19; and sub conveyance path 28 for inverting paper P by driving paper discharge roller 19 in reverse to switch back the paper using inversion roller 29.

Paper feed path 25 is extended approximately linearly but gently curved, from an unillustrated separation roller which separates the paper, sheet by sheet if double or multiple sheets of paper are fed and is located on the downstream side of paper pickup roller 24 with respect to the paper's direction of conveyance, to registration roller 26 arranged in the vicinity of the lower side (the upstream side with respect to the paper's direction of conveyance) of photoreceptor drum 11 of image forming portion 10.

Main conveyance path 16 is formed approximately linearly from the downstream side of registration roller 26 to fixing unit 30 by way of image forming portion 10, and is followed by a curved part 16*a* that bends smoothly extending approximately upward from the exit side (the downstream side with respect to the paper's direction of conveyance) of fixing unit 30 toward paper discharge drive roller 18 (to the left in the drawing).

Paper discharge path 17 is extended approximately linearly between paper discharge drive roller 18 and paper discharge roller 19.

Specifically, sub conveyance path 28 includes a first curved part 28*a* for deflecting the direction of movement of paper P that is conveyed in reverse from paper discharge path 17 towards the bottom of the machine and a second curved part 28*b* for deflecting the direction of movement of paper P that is conveyed around the bottom of the machine towards the registration roller 26.

Next, the control system of image forming apparatus 1 according to the embodiment will be described in detail with reference to the drawings.

FIG. 3 is a block diagram showing an electric controller configuration of the image forming apparatus according to the present embodiment.

As shown in FIG. 3, image forming apparatus 1 according to the embodiment performs processes such as image reading, image processing, image forming and conveyance of paper P, etc., by a central processing unit (CPU) 54 which performs control in accordance with the program stored beforehand in ROM (read only memory) 55, using temporal storage such as RAM (random access memory) 56 etc. It is also possible to use other storages such as a HDD (hard disk drive) etc., instead of ROM and RAM.

In image forming apparatus 1, the image information of an original (original image data) captured by scanner portion (original reading portion) 3, or original image information transmitted from other terminal devices connected via an unillustrated communication network, is adapted to be input to image processing portion 57 by way of a communication processor 58.

Image processor 57 shapes the original image information stored in the storage such as RAM 56 or the like into a printing image that is suitable for printing (image forming onto paper), in accordance with the aforementioned program.

The printing image information is input to image forming portion 10.

Image forming portion 10, paper conveying portion (performing various detections and controls of paper P in paper feed path 25, main conveyance path 16, sub conveyance path 28 (these are also called paper guides)) 59, fixing unit 30 and paper discharge processor (performing various detections and controls of paper P in paper discharge path 17) 60 are linked with respective drive controllers 62.

Paper conveying portion 59 conveys paper P through the printing stage (image information is printed in image forming portion 10) and the fixing stage where the paper P having been printed is fixed (in fixing unit 30) and then discharges the sheet to paper discharge portion (paper output tray 22*a*).

Here, paper conveying portion 59 receives detection signals from fixing detection switch 21A, paper discharge detecting switch 21B, pre-registration detection switch 21C etc.

Image forming apparatus 1 has an operational condition setter 77. This operational condition setter 77 sets up operational conditions for image forming and conditions of conveyance etc., in image forming apparatus 1, in accordance with the image forming request and the image forming conditions such as the type of recording media etc., designated by the user through control switches 76.

Further, in image forming apparatus 1, based on the set operating conditions, drive controller 62 is adapted to control drive actuators for the aforementioned scanner portion 3, paper conveying portion 59, image forming portion 10, fixing unit 30, paper discharge processor 60 etc., namely, an original reading driver 64, a paper conveyance driver 66, a printing process driver 68, a fixing driver 70 and a paper discharge driver 72 so that they can operate in synchronization with instructions from CPU 54 in accordance with the program stored in ROM 55.

Paper discharge processor 60 makes control of a paper discharge process of discharging the printed paper to the paper output tray and performs the paper discharge process based on the signal output from paper stack quantity detecting sensor 21D.

Original reading driver 64 includes a drive actuator for the first scanner unit 4 and the second scanner unit 5 of scanner portion 3.

Paper conveyance driver 66 means paper conveying portion 59, specifically, drive motors for paper pickup roller 24 and registration roller 26 along the aforementioned paper feed path 25.

Printing process driver 68 is a drive motor for photoreceptor drum 11.

Fixing driver 70 includes drive motors for heat roller 31 and pressing roller 32 in fixing unit 30.

Paper discharge driver 72 includes drive motors for paper discharge drive roller 18, paper discharge roller 19 etc. All these drive motors of the drivers may be configured of common or different motors or drive sources with appropriate power transmission mechanisms.

Further, image forming apparatus 1 may be used with automatic document processor 40 as an optional configuration 74. Each optional configuration 74 incorporates an individual controller 74*a* separately from the controller of the image forming apparatus 1 so as to operate in synchronization with the main apparatus by performing timing adjustment via the aforementioned communication processor 58.

A recording medium detecting portion 78 detects arrival of the leading end of the recording medium at fixing unit 30 or the discharge portion. Recording medium detecting portion 78 is adapted to detect the timings at which the paper P arrives at (enters) fixing unit 30 and paper discharge drive roller 18, based on the conveyance timing of the recording medium detected by an aftermentioned conveyance timing detecting portion 79*b*.

Specifically, recording medium detecting portion 78 includes: a conveyance time measuring portion 79*a* for measuring the time of conveyance of paper P from when the paper P is delivered from registration roller 26 at the entrance of paper feed path 25 where the paper P is introduced; and a conveyance timing detecting portion 79*b* for detecting the timings at which paper P is conveyed in main conveying path 16 and in paper discharge path 17, based on the distances from registration roller 26 to fixing unit 30 and discharge drive roller 18 to be controlled and the paper's speed of conveyance.

In the image forming apparatus 1 configured as above, the configuration of paper discharge portion 22 that features the present embodiment will be hereinbelow described in detail with reference to the drawings.

Figure 4:
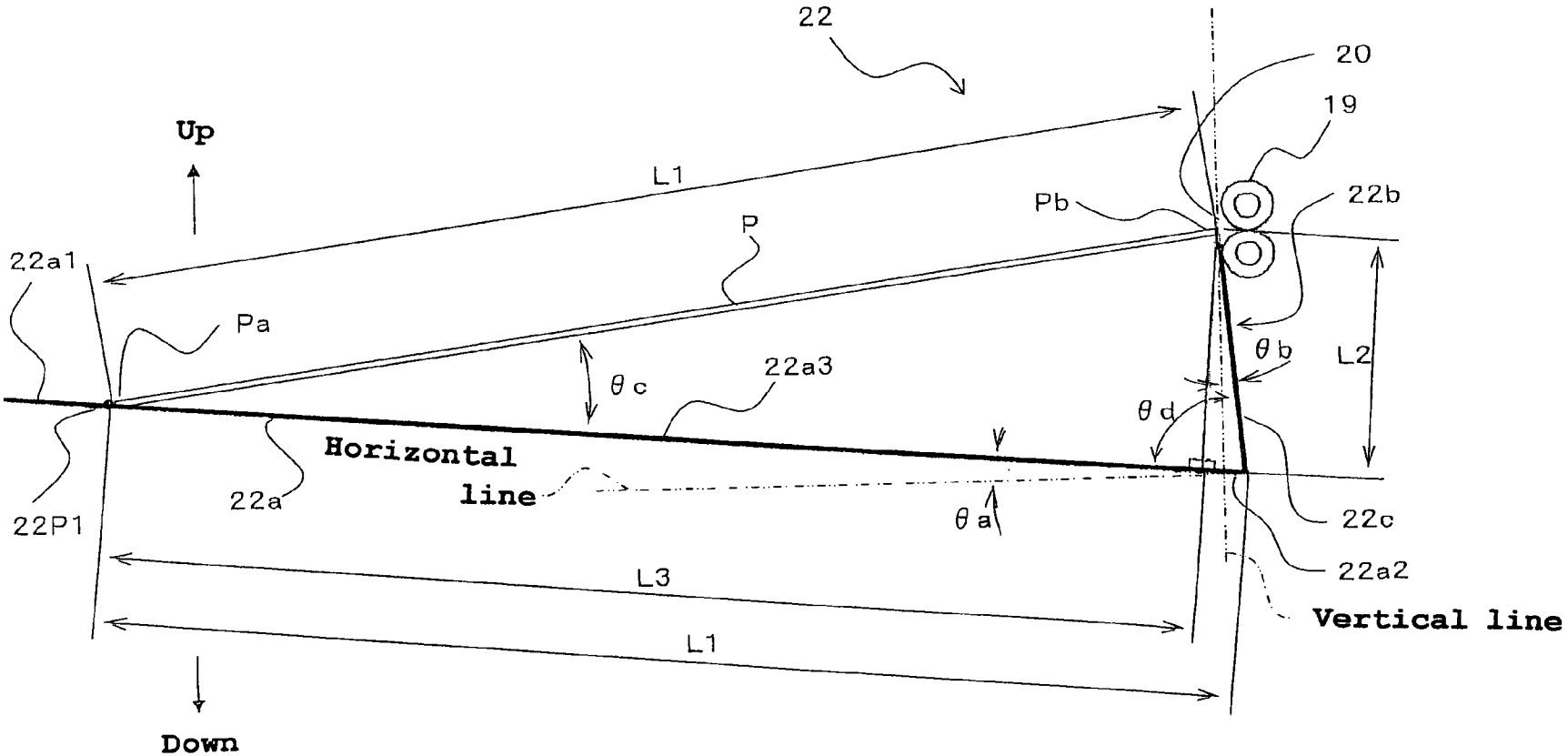
FIG. 4 is a schematic illustrative view showing a configuration of a paper discharge portion that constitutes the image forming apparatus.

FIG. 4 is a schematic illustrative view showing the configuration of the paper discharge portion according to the present embodiment.

The paper discharge portion 22 according to the present embodiment is arranged so that, as shown in FIG. 2, paper discharge port 20 is formed on the downstream side, with respect to the direction of discharge, of paper discharge roller 19 laid out in the center of the main body while paper output tray 22*a* is disposed on the downstream side, with respect to the direction of discharge, of paper discharge roller 19 and below paper discharge roller 19.

A side-wall surface 22*b* is formed on the machine body side from paper discharge port 20 to the vicinity of paper output tray 22*a*. Side-wall surface 22*b* as well as paper output tray 22*a* constitutes part of the exterior of apparatus body 1*a*.

Paper output tray 22*a* is configured as a slope with an inclination angle θa relative to the horizontal direction so that its front end 22*a*1 side corresponding to the front end Pa of discharged paper P is located higher than the proximal end 22*a*2 side corresponding to the rear end Pb of paper P, as shown in FIG. 4.

The top surface of paper output tray 22*a*, namely, paper stacking portion 22*a*3 is sized so that the distance from the position (front position) 22P1 which front end Pa of the paper P discharged from discharge roller 19 reaches to the proximal end 22*a*2 is equal to the length L1 of the longest sheet of paper P used for this image forming apparatus 1.

Proximal end 22*a*2 of paper output tray 22*a* is located a distance L2 below paper discharge port 20 and at a position further interior from the paper discharge port 20 toward the upstream side (the interior side of the machine) with respect to the direction of paper discharge.

Side-wall surface 22*b* is formed with an inclined portion 22*c* which extends from the lower part of paper discharge roller 19 to the vicinity of proximal end 22*a*2 of paper discharge tray 22*a* and is inclined with respect to the vertical line, going further interior at the bottom of side-wall surface 22*b*. More specifically, inclined portion 22*c* is formed at an inclination angle θb so that it goes further interior toward the upstream side (the interior side of the machine) as it goes downwards from paper discharge port 20. Further, the inclined portion is formed so that its width or its distance in the paper width direction becomes smaller as it goes down from paper discharge roller 19.

In this arrangement, the angle of paper P entering to paper output tray 22*a* is named θc and the angle formed between paper output tray 22*a* and inclined portion 22*c* is named θd.

The inclination angle θb of inclined portion 22*c* set back to the upstream side of the paper discharge direction (to the interior side of the machine) is determined, as shown in FIG. 4, based on the distance (vertical distance) L2 from paper discharge roller 19 to paper output tray 22*a*, the length L1 of the longest paper P to be discharged from paper discharge roller 19 and the position 22P1, on paper output tray 22*a*, which front end Pa of paper reaches when rear end Pb of paper P is released from the paper discharge roller.

Figure 5:
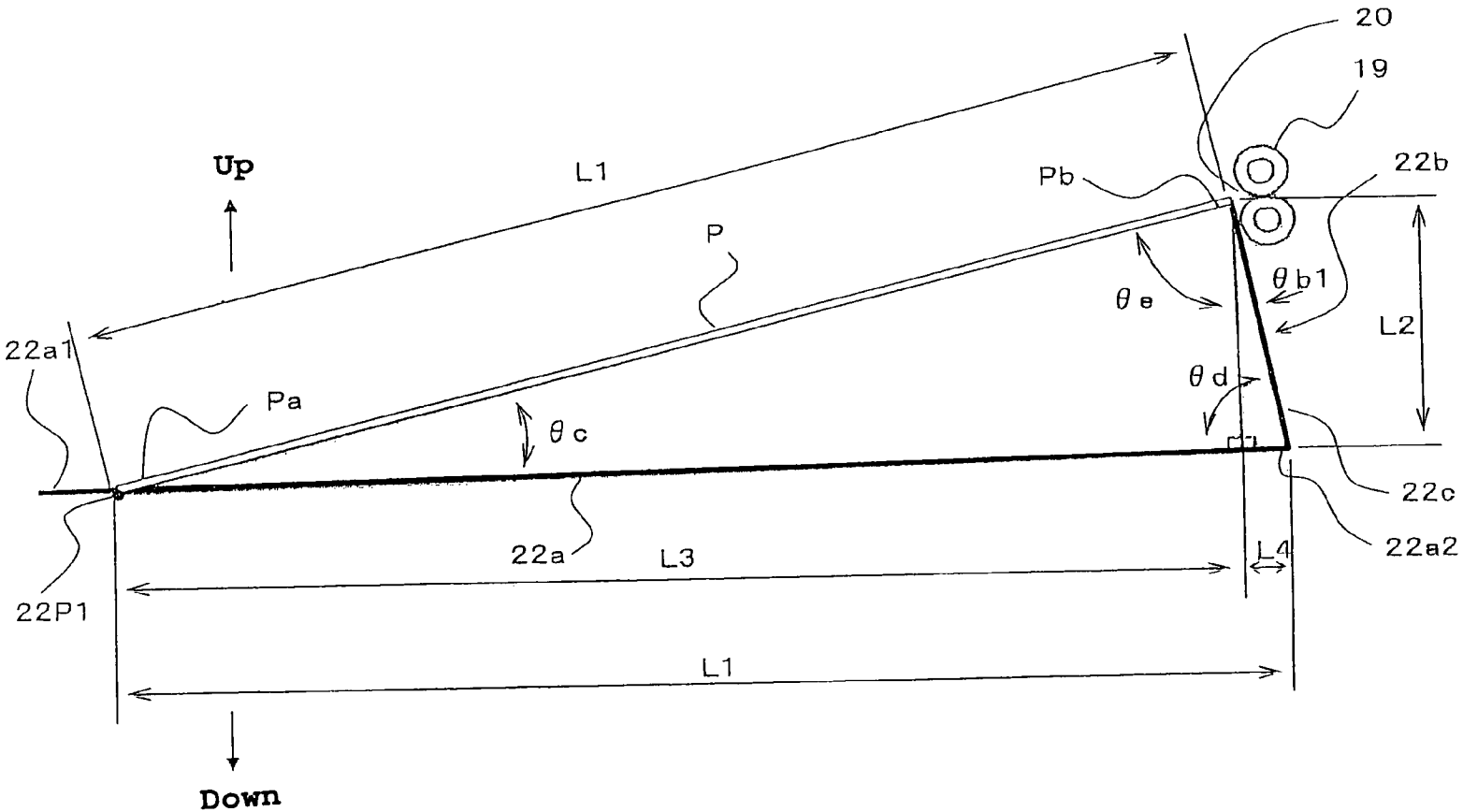
FIG. 5 is a schematic illustrative view showing a state where a paper output tray for the paper discharge portion is placed horizontally.

Now, how to determine the inclination angle θb will be described referring to a state in which paper out tray 22*a* is set horizontally. FIG. 5 is an illustrative view showing a state where the paper output tray according to the present embodiment is placed horizontally.

As the value of each part is determined with paper output tray 22*a* set horizontally as shown in FIG. 5, angle θc is determined from L1 and L2, L3 is determined from angle θc and L1, and L4 is determined from L1 and L3. As a result, the inclination angle θb1 can be determined from L2 and L4.

That is, in the present embodiment, since paper output tray 22*a* is arranged to be inclined an angle θa with respect to the horizontal direction, the inclination angle ←b of inclined portion 22*c* takes a value calculated by subtracting the angle θa from the inclination angle θb1, which is determined as above. In this way, it is possible to determine the inclination angle θb of inclined portion 22*c*.

Accordingly, the inclination angle θb1 can be determined from the values which are obtained based on paper P's length L1, the distance (vertical distance) L2 from paper discharge roller 19 to paper output tray 22*a*, and the position 22P1, on paper output tray 22*a*, which front end Pa of paper P reaches when rear end Pb of paper P is released from the paper discharge roller.

Next, the discharging operation of paper P by paper discharge portion 22 according to the present embodiment will be described with reference to the drawings.

Paper P discharged from paper discharge port 20 by paper discharge roller 19 is made to fall over paper output tray 22*a* as shown in FIG. 4.

The paper P that falls over paper output tray 22*a* is adapted to advance until its front end Pa reaches the front end 22*a*1 side of paper output tray 22*a*, then the rear end Pb falls down to proximal end 22*a*2 of paper output tray 22*a*.

When front end Pa of paper P reaches paper output tray 22*a*, paper P takes a position with its front end Pa inclined downwards. As paper P is released onto paper output tray 22*a* from this state, paper P moves down with its rear end Pb tracing an approximately circular arc locus with its front end Pa as a center.

In this case, rear end Pb, after it is released from paper discharge roller 19, moves down along an approximately circular arc from the position of paper discharge port 20. Accordingly, the locus reaches proximal end 22*a*2 of paper output tray 22*a* from the position of paper discharge port 20, passing by the trace located further inwards to the interior to the apparatus body from the position of paper discharge port 20.

Since the side-wall surface 22*b* opposing rear end Pb of paper P is formed with inclined portion 22*c* that is inclined inwards from the lower part of paper discharge portion 20 to proximal end 22*a*2, rear end Pb of paper P will not remain stagnated and leaning on side-wall surface 22*b* but is able to reach proximal end 22*a*2 of paper discharge tray 22*a* smoothly.

Here, when a large number of sheets of paper P have built up on paper output tray 22*a* with the progress of discharging of paper P, the position onto which discharged paper P falls becomes higher, hence the angle of falling paper P with the stacking surface becomes smaller (shallower). As a result, rear end Pb of paper P moving downwards passes by the trace located less inwards to the interior side of the apparatus body, so that paper P can fall with smoother movement along inclined portion 22*c*.

According to the present embodiment configured as described above, since inclined portion 22*c* that is inclined toward the interior of the apparatus is formed in the portion where side-wall surface 22*b* opposes rear end Pb of paper P, as paper discharge portion 22, it is possible to stack sheets of paper in a tidy manner without causing rear end Pb of paper P leaning against side-wall surface 22*b*.

Further, according to the present embodiment, since the front end side of paper output tray 22*a* is arranged at a higher position so that the placement surface of the tray is inclined, it is possible to prevent discharged sheets of paper P from slipping down in the paper's direction of discharge and collect the sheets to the proximal end 22*a*2 side.

Figure 6:
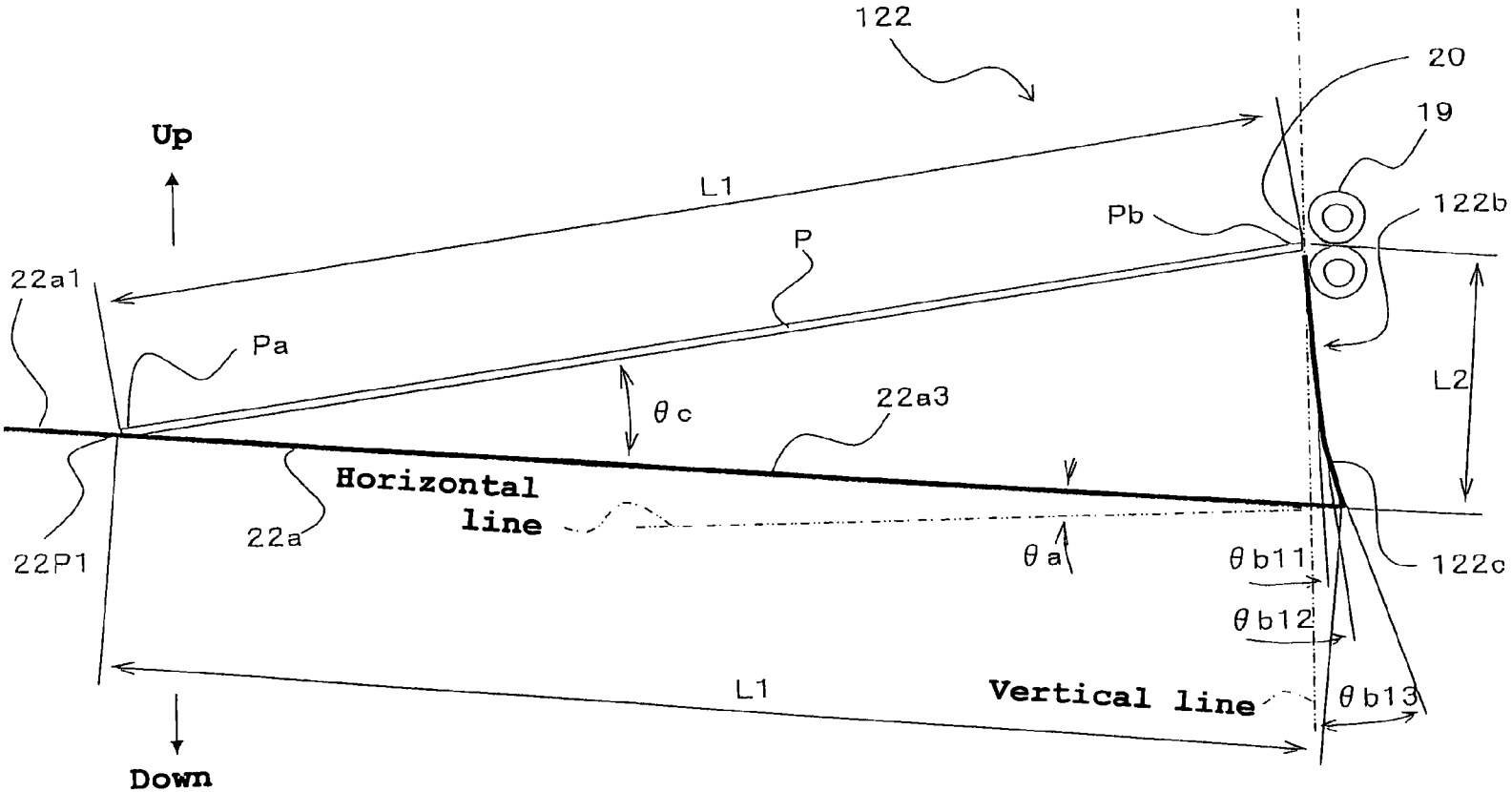
FIG. 6 is a schematic illustrative view showing a variational configuration example of a paper discharge portion according to the present embodiment.

Though in the present embodiment, inclined portion 22*c* is formed linearly from paper discharge portion 20 downwards, as a variational example of a discharge portion 122 an inclined portion 122*c* whose inclination to the interior of the apparatus may be increased stepwise as shown by θc11, θc12 and θc13 in FIG. 6 as it goes downwards. With this configuration, it is possible to stack paper P in the optimal condition depending on the height of the stack of paper P having been discharged as described above.

Figure 7:
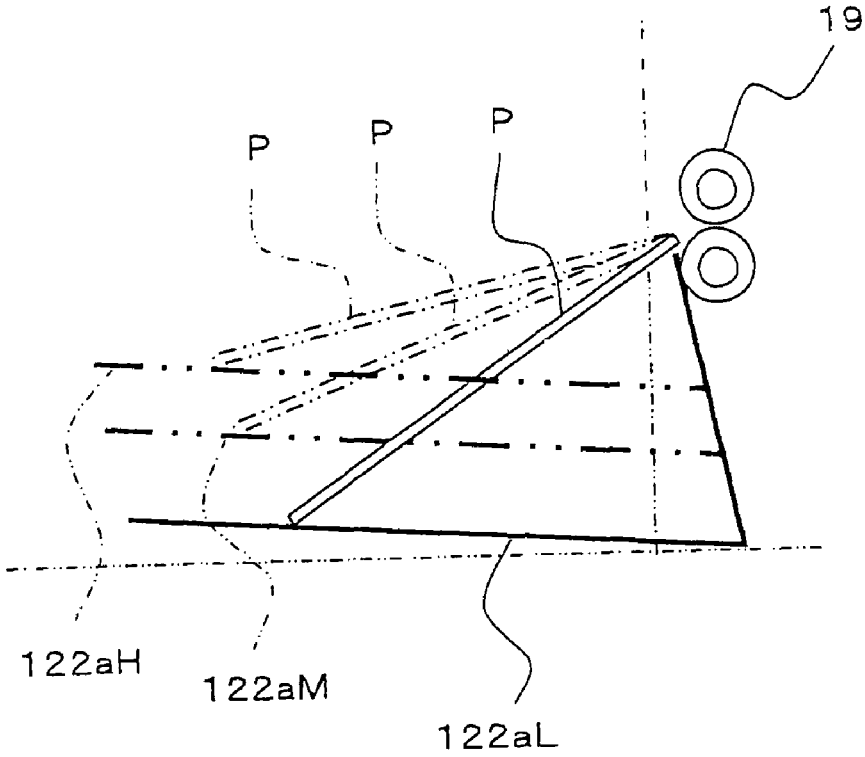
FIG. 7 is a schematic illustrative view showing another variational configuration example of the paper discharge portion.

Alternatively, since the position of falling paper P varies depending on the paper discharge speed V, it is possible to provide another variational example of a paper discharge tray, which has an inclined portion whose height can be varied stepwise, at 122aH, 122aM and 122aL, for example, corresponding to the high paper discharge speed VH, medium paper discharge speed VM and low paper discharge speed VL, respectively, as shown in FIG. 7.

What is claimed is:

1. A paper discharge structure comprising:

a paper discharge roller for discharging a recording medium with an image formed thereon from a discharge port;

a paper output tray located below the paper discharge roller for holding recording mediums discharged by the paper discharge roller; and a side-wall surface formed extending from an output of the paper discharge roller to the paper output tray, wherein the side-wall surface is formed with a first inclined portion that extends from the output of the paper discharge roller toward the paper output tray and is inclined with respect to the vertical direction, the first inclined portion is inclined along a straight axis from the output of the paper discharge roller to the paper output tray, the side-wall surface is formed with a second inclined portion, and the second inclined portion is formed so that its angle of inclination with respect to the vertical direction is made greater than the first inclined portion angle of inclination with respect to the vertical direction.

2. The paper discharge structure according to claim 1, wherein the second inclined portion is formed so that its angle of inclination is made greater stepwise than the angle of inclination of the first inclined portion.

3. The paper discharge structure according to claim 2, wherein the angle of inclination of the first and second inclined portions are determined based on the distance from the paper discharge roller to the paper output tray normal to the paper output tray, the length of the longest recording medium of the recording mediums that can be handled and discharged from the paper discharge roller and the position, on the paper discharge tray, which the front end of the longest recording medium reaches when the rear end of the recording medium is released from the paper discharge roller.

4. The paper discharge structure according to claim 1, wherein the angle of inclination of the first and second inclined portions are determined based on the distance from the paper discharge roller to the paper output tray normal to the paper output tray, the length of the longest recording medium of the recording mediums that can be handled and discharged from the paper discharge roller and the position, on the paper discharge tray, which the front end of the longest recording medium reaches when the rear end of the recording medium is released from the paper discharge roller.

5. The paper discharge structure according to claim 4, wherein the position, on the paper discharge tray, which the front end of the longest recording medium reaches when the rear end of the recording medium is released from the paper discharge roller is determined based on the angle of inclination of the recording medium stacking portion of the paper output tray.

6. An image forming apparatus comprising:

a recording medium conveying portion for conveying recording mediums;

an image forming portion for forming an image on a recording medium being conveyed, in accordance with input image information; and a paper discharge structure, wherein the paper discharge structure comprises:

a paper discharge roller for discharging a recording medium with an image formed thereon from a discharge port;

a paper output tray located below the paper discharge roller for holding recording mediums discharged by the paper discharge roller; and a side-wall surface formed extending from an output of the paper discharge roller to the paper output tray, wherein the side-wall surface is formed with a first inclined portion that extends along a straight axis from the output of the paper discharge roller to the paper output tray and is inclined with respect to the vertical direction, wherein the side-wall surface is formed with a second inclined portion, and the second inclined portion is formed so that its angle of inclination with respect to the vertical direction is made greater than the first inclined portion angle of inclination with respect to the vertical direction.

7. The image forming apparatus according to claim 6, wherein the second inclined portion is formed so that its angle of inclination is made greater stepwise than the angle of inclination of the first inclined portion.

8. The image forming apparatus according to claim 7, wherein the angle of inclination of the first and second inclined portions are determined based on the distance from the paper discharge roller to the paper output tray normal to the paper output tray, the length of the longest recording medium of the recording mediums that can be handled and discharged from the paper discharge roller and the position, on the paper discharge tray, which the front end of the longest recording medium reaches when the rear end of the recording medium is released from the paper discharge roller.

9. The image forming apparatus according to claim 6, wherein the angle of inclination of the first and second inclined portions are determined based on the distance from the paper discharge roller to the paper output tray normal to the paper output tray, the length of the longest recording medium of the recording mediums that can be handled and discharged from the paper discharge roller and the position, on the paper discharge tray, which the front end of the longest recording medium reaches when the rear end of the recording medium is released from the paper discharge roller.

10. The image forming apparatus according to claim 9, wherein the position, on the paper discharge tray, which the front end of the longest recording medium reaches when the rear end of the recording medium is released from the paper discharge roller is determined based on the angle of inclination of the recording medium stacking portion of the paper output tray.

* * * * *